United States Patent [19]

Flick

[11] 4,232,805

[45] Nov. 11, 1980

[54] SEWING FORM

[76] Inventor: Sally J. Flick, 10905 Westfield Blvd., Indianapolis, Ind. 46280

[21] Appl. No.: 794,176

[22] Filed: May 5, 1977

[51] Int. Cl.[3] ..... A41H 33/00

[52] U.S. Cl. ..... 223/37; 112/136

[58] Field of Search ..... 223/33, 34, 35, 37, 223/38; 112/136, 147, 153; 33/2 H, 180 R, 169 R, 174 G

[56] References Cited

U.S. PATENT DOCUMENTS

| | | | |
|---|---|---|---|
| 1,145,244 | 7/1915 | Hoffmann | 112/153 X |
| 2,644,236 | 7/1953 | Pallos | 33/2 H |
| 2,814,116 | 11/1957 | Goodman | 33/2 H |
| 3,352,466 | 11/1967 | McAllister | 223/38 |
| 3,369,303 | 2/1968 | Henry | 33/174 G |

*Primary Examiner*—George H. Krizmanich
*Attorney, Agent, or Firm*—John H. Calhoun, Jr.

[57] ABSTRACT

A solid, rectilinear sewing form of thin, rigid construction and a process for using the sewing form to hand make cloth trim tape, cloth pockets or folded cloth rope is provided. The width of the sewing form controls the width of the finished cloth trim tape, cloth pockets, or folded cloth rope. The form is laid on top of cloth material so that the edges of the cloth material extend beyond the longitudinal edges of the form. The cloth extensions are then folded back over the sewing form using the edges of the form as parallel folding guides, and the cloth is creased at the folds by pressing with a hot iron. Longitudinal grooves run the length of the sewing form and serve as cutting guides for trimming the folded and creased cloth. Folded cloth rope is produced by making a third longitudinal fold and crease in the cloth material using the form as a folding guide, and thereafter stitching together the two edges formed by the first two creases.

4 Claims, 10 Drawing Figures

SEWING FORM

BACKGROUND OF THE INVENTION

Cloth trim tape, cloth pockets and folded cloth rope have many uses in the sewing trade. Unattractive raw cut edges of necklines, hemlines and sleeves of well made garments are often concealed by folding strips of decorative trim tape over the cut edges of garments and stitching the trim tape to the garments. Attractive and desirable decorative effects can also be produced by stitching strips or patterns of trim tape to other parts of garments. Trim tape may be selected to match garment fabrics in color, pattern or texture, to contrast with garment fabrics, or to produce other desired decorative effects. Cloth pockets are often used to hold curtain rods, draw strings, and elastic cords. Folded cloth rope can be used for braiding rugs, macrame, crocheting, or knitting.

Trim tape with longitudinal stretch can be stitched onto a garment in a curved pattern without introducing unwanted wrinkles, and such tape is made from a variety of cloth materials. Bias trim tape is made using woven non-stretch fabrics that are cut on a bias and folded and pressed to produce two parallel longitudinal creases along the edges of the tape. Trim tape is also produced from one-way-stretch knit fabrics by folding and pressing the fabric so that the parallel longitudinal creases are in the direction of stretch of the fabric. Similiarly, trim tape with longitudinal stretch is produced from two-way-stretch knit fabrics by folding and pressing the fabric so that the parallel longitudinal creases are in one of the directions of stretch of the fabric. Non-stretch trim tape is also used for some purposes, and such tape is produced by folding and pressing woven non-stretch fabric so that the parallel longitudinal creases are in the direction of or perpendicular to the straight of the material or so that the parallel longitudinal creases are perpendicular to the direction of stretch of one-way-stretch knit fabrics.

Trim tape is available commercially in assorted fabrics, patterns, colors and sizes, and a person can extend the choice of trims by hand making his or her own trim tape from cloth of any desired kind, color, pattern or size.

One method for hand making trim tape is to hand cut fabric approximately twice as wide as the desired width of the finished tape and thereafter to fold the fabric on itself and along its length so that the longitudinal cut edges of the fabric abut each other along a line running the length of the finished tape and approximately in the center of one side of the finished tape. Creases are formed along the edges of the folded fabric by pressing the edges with a hot iron. To produce trim tape by this method the fabric must be precisely cut and the folds exactly located by a process of repeatedly measuring, folding and pressing short increments along the length of the fabric. This process is awkward and slow and has a tendency to produce tape that varies in width along its length and in which the longitudinal cut edges of the fabric tend to gap or to overlap at points along the length of the tape, thereby producing undesired bulges and voids in the tape.

A second method for hand making trim is to form the trim on the garment. This is accomplished by stitching one edge of the trim cloth to the cut edge of the garment that is being trimmed and thereafter folding and creasing the trim cloth along its length to form the finished trim in place on the garment. The free edge of the folded trim is then stitched to the garment. This method suffers from the same deficiencies as the first method.

Cloth pockets are hand made by methods similar to those used to make trim tape, except that the cloth folds are relatively narrower and the longitudinal cut edges of the fabric may not abut each other as in the case of trim tape.

Present methods for hand making cloth trim tape, cloth pockets, and folded cloth rope are awkard and slow and the resulting tape, pocket or rope tends to be of uneven width and thickness. The present invention provides an instrument and process for rapidly and conveniently hand making cloth trim tape, cloth pockets and folded cloth rope of more uniform width and thickness and having a more pleasing appearance than tape, pockets or rope made by other hand methods.

SUMMARY OF THE INVENTION

An object of this invention is to provide a solid, flat, rigid, rectilinear sewing form that will not shrink, warp, melt or otherwise change form or composition when heated with a hot iron and a process for using the form to hand make cloth trim tape, cloth pockets, or folded cloth rope which is more uniform in width and thickness and more pleasing in appearance than cloth trim tape, cloth pockets or folded cloth rope made by other hand methods. Another object of this invention is to provide a sewing form and process for using the form to hand make cloth trim tape, cloth pockets or folded cloth rope more rapidly and more conventiently than is possible by other hand methods. Another object of this invention is to provide a sewing form with conveniently located cutting guides in the form of longitudinal grooves in the top surface of the form. Yet another object of this invention is to provide a sewing form with rounded corners so that the form will not snag the cloth that is being used to hand make cloth trim tape, cloth pockets or folded cloth rope. An additional object of this invention is to provide a sewing form that can be conveniently stored by hanging on a wall.

The width of the sewing form is determined by the desired width of the finished cloth trim tape, cloth pocket or folded cloth rope, and cloth trim tape, cloth pockets or folded cloth rope of any desired width can be produced by selecting a sewing form of the proper width. The length of the form can be any convenient length. The form is made as thin as practical consistent with the requirement that it be rigid. Cutting guides are provided at several locations in the top surface of the form. A cutting guide is located slightly off the center of the top surface of the form, and this guide is used to produce cloth trim tape in which one side is narrower than the other side. Trim tape of this kind may be placed on a garment with the narrow side on the top so that the bottom side will be automatically stitched during application. A pair of cutting guides are placed equidistant from the longitudinal edges of the form, and these guides are used for trimming the edges of cloth for cloth pockets. Another cutting guide is located along the center of the form, and this guide is used to trim the edges of cloth for folded cloth rope. The corners of the form are rounded and smooth to avoid snagging the cloth, and a hole through the form of any convenient size and shape is located near one end of the form for convenience in hanging the form for storage. Useful information such as a centimeter scale, inch scale, or the width of the sewing form may be printed, embossed or otherwise displayed on the top or bottom of the sewing form or both.

The sewing form may be made of metal or any other material that will provide adequate rigidity and which will not shrink, warp or melt or otherwise change form or composition when heated with a hot iron.

The cloth for making cloth trim tape, cloth pockets or folded cloth rope is laid on a table, and the sewing form, with the cutting guides on top, is laid on top of the cloth such that the cloth extends beyond both longitudinal edges of the form. The cloth extensions are folded back over the form using the longitudinal edges of the form as folding guides. Creases are produced in the cloth by pressing the folds with a hot iron. The longitudinal cut edges of the cloth are then trimmed using the cutting guides to facilitate making quick, straight cuts without the need for repeated measurements. To produce cloth trim tape, the cutting guide that is slightly off the center of the top surface is used. To produce cloth pockets the pair of cutting guides that are equidistant from the edges of the form are used. Folded cloth rope is produced by trimming the edges of the folded cloth using the cutting guide along the center of the top surface of the sewing form and thereafter removing the form from within the folded cloth, placing one edge of the form on and along the line formed by the trimmed edges of the cloth, folding the exposed half of the folded cloth back over the sewing form using the edge of the form as a folding guide, creasing the cloth at this third fold by pressing the cloth with a hot iron, removing the form from within the folded cloth, and stitching together the two longitudinal edges formed in the cloth by the first and second creases.

BRIEF DESCRIPTION OF THE DRAWINGS

The many objects and advantages of a sewing form that is made according to this invention will become apparent upon consideration of the following detailed discussion and the accompanying drawings in which.

DESCRIPTION OF THE PREFERRED EMBODIMENT

Figure 1:
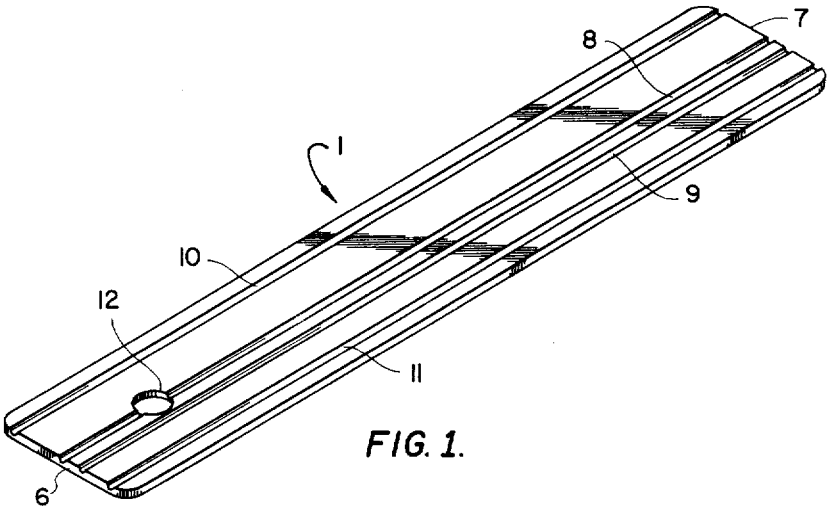
FIG. 1 is a perspective view showing the sewing form that is a subject of this invention.
Figure 2:
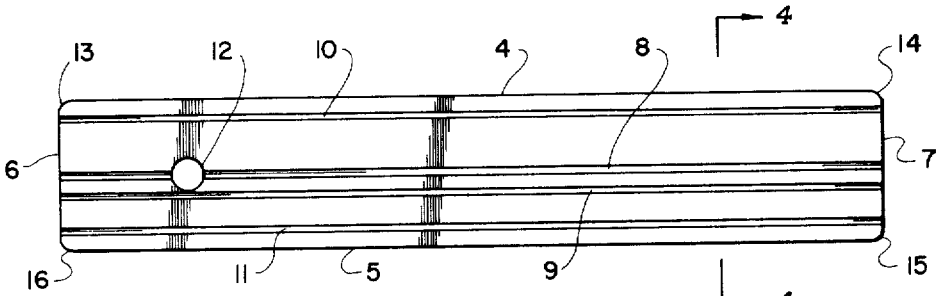
FIG. 2 is a top plane view of the sewing form.
Figure 3:
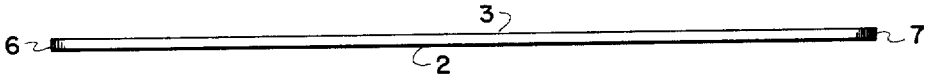
FIG. 3 is a side elevation view of the sewing form.

FIGS. 1, 2 and 3 illustrate the thin, rigid, solid, rectilinear sewing form 1 that is constructed in accordance with the concepts of this invention. The form 1 comprises a rectangular planar bottom surface 2, an opposing and parallel rectangular planar top surface 3, a pair of opposing and parallel rectangular planar sides 4 and 5 perpendicular to the bottom 2 and the top 3, a pair of opposing and parallel rectangular planar ends 6 and 7 perpendicular to the bottom 2, the top 3 and the sides 4 and 5, four parallel longitudinal grooves 8, 9, 10 and 11 adapted for guiding a cutting instrument such as a pair of scissors or a knife and running the length of the form and located in the top 3, and a hole 12 through the form 1.

The corners 13, 14, 15 and 16 of the form 1 are rounded and smooth as illustrated in FIG. 2.

Figure 4:
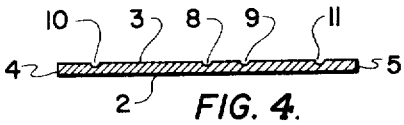
FIG. 4 is an enlarged cross section view taken along line 4—4 of FIG. 2.

The grooves 8, 9, 10 and 11 may be of any convenient cross section and size. The centerline of groove 8 is located on and along the centerline of the top 2 as illustrated in FIG. 4. The centerline of groove 9 is located slightly off the centerline of the top 2. The distance between the centerline of groove 9 and the centerline of the top 2 is selected to provide the desired difference in width for the two sides of cloth trim tape. The centerlines for the pair of grooves 10 and 11 are equidistant from the sides 4 and 5 respectively. The distance between the centerlines of grooves 10 and 11 and the side 4 or 5 nearest each is selected to provide the desired amount of overlap for cloth pockets.

The width of the form 1 is selected to provide the desired width for the finished cloth trim tape, cloth pocket or folded cloth rope. The length of the form 1 may be any convenient length. The form 1 is made as thin as practical consistent with the requirement that it be rigid. A circular hole 12 through the form of any convenient size is located equidistant from the longitudinal edges 4 and 5 of the form 1 and 1" from either end 6 or 7.

The form 1 is made of metal or any other material that provides adaquate rigidity and which will not shrink, warp, melt or otherwise change form or composition when heated with a hot iron.

Figure 5:
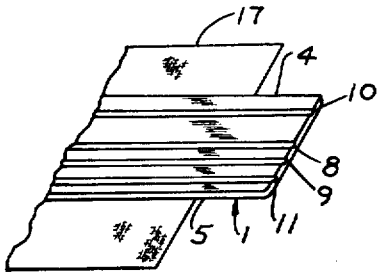
FIG. 5 is a fragmentary perspective view showing the sewing form laid on a piece of cloth.

As shown in FIG. 5, the cloth 17 for making cloth trim tape, cloth pockets or folded cloth rope is laid on a table, and the form 1 with the cutting guides 8, 9, 10 and 11 on the top is laid on the cloth so that the cloth extends beyond both sides 4 and 5 of the form 1.

If cloth trim tape, cloth pockets or folded cloth rope is to be made with longitudinal stretch from woven non-stretch fabric the form 1 is laid on the cloth material so that the longitudinal axis of the form 1 is rotated from the direction of the straight of the cloth material by 45°. If cloth trim tape, cloth pockets or folded cloth rope is to be made with longitudinal stretch from one-way-stretch knit fabric the form 1 is laid on the cloth material so that the longitudinal axis of the form 1 is parallel with the direction of stretch of the cloth material. If cloth trim tape, cloth pockets or folded cloth rope is to be made with longitudinal stretch from two-way-stretch knit fabric the form 1 is laid on the cloth material so that the longitudinal axis of the form 1 is parallel with one of the directions of stretch of the cloth material. If cloth trim tape, cloth pockets or folded cloth rope is to be made without longitudinal stretch from woven non-stretch fabric the form 1 is laid on the cloth material so that the longitudinal axis of the form 1 is parallel with or perpendicular to the direction of the straight of the material. If cloth trim tape, cloth pockets or folded cloth rope is to be made without longitudinal stretch from one-way-stretch knit fabric the form 1 is laid on the cloth material so that the longitudinal axis of the form 1 is perpendicular to the direction of stretch of the cloth material.

Figure 6:
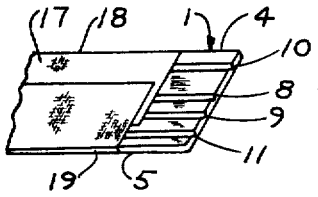
FIG. 6 is a fragmentary perspective view showing a sheet of cloth folded over the sewing form.

To make cloth trim tape the cloth extensions beyond the sides 4 and 5 of the form 1 are made wide enough so that when the cloth extensions are folded back over the form 1 using the sides 4 and 5 of the form 1 as folding guides both cloth extensions when folded will overlap the groove 9, as shown in FIG. 6. To make cloth pockets the cloth extensions beyond the sides 4 and 5 of the form 1 are made wide enough so that when the cloth extensions are folded back over the form 1 using the sides 4 and 5 of the form 1 as folding guides the cloth extension beyond the side 4 will overlap the groove 10 when folded and the cloth extension beyond the side 5 will overlap the groove 11 when folded. To make folded cloth rope the cloth extensions beyond the sides 4 and 5 of the form 1 are made wide enough so that when the cloth extensions are folded back over the form 1 using the sides 4 and 5 of the form 1 as folding guides both cloth extensions when folded will overlap the groove 8.

The cloth extension on one side 4 or 5 of the form 1 is folded over the form 1 using the side 4 or 5 of the form 1 as a folding guide, as shown in FIG. 6. A first longitudinal crease is formed in the cloth 17 along this first fold by pressing the cloth with a hot iron along the first fold. The cloth extension on the other side 5 or 4 of the form 1 is folded over the form 1 using the side 5 or 4 of the form 1 as a folding guide. A second longitudinal crease 19 is formed in the cloth along this second fold by pressing the cloth with a hot iron along the second fold.

Figure 7:
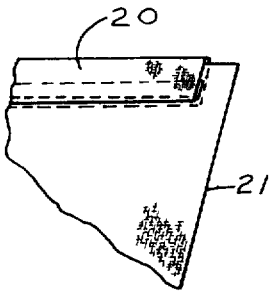
FIG. 7 is a fragmentary perspective view showing cloth trim tape as it would appear stitched to a garment.

To make cloth trim tape the overlapped layers of folded and creased cloth on the top 3 of the form 1 are trimmed by cutting both layers simultaneously along the length of the form 1 using the groove 9 as a cutting guide to facilitate making a quick, straight cut without the need for repeated measurements. The tool 1 is then removed from the cloth trim tape and the colth trim tape 20 thus produced may then be folded over the raw cut edge of a garment 21 as shown in FIG. 7 and stitched to the garment to provide the desired decorative effect.

Figure 8:
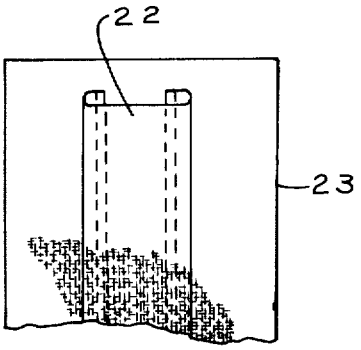
FIG. 8 is a fragmentary perspective view showing a cloth pocket as it would appear stitched to a piece of cloth.

To make cloth pockets the cloth extension folded over the side 4 of the form 1 is trimmed by cutting the cloth along the length of the form 1 using the groove 10 as a cutting guide to facilitate making a quick, straight cut without the need for repeated measurements, and the cloth extension folded over the side 5 of the form 1 is trimmed by cutting the cloth 17 along the length of the form 1 using the groove 11 as a cutting guide to facilitate making a quick, straight cut without the need for repeated measurements. The form 1 is removed from within the cloth leaving a layer of formed cloth 22 that becomes a pocket when stitched to a second sheet of cloth 23 as shown in FIG. 8.

Figure 9:
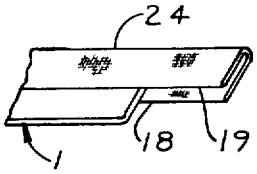
FIG. 9 is a fragmentary perspective view showing the formation of a third longitudinal crease as is required to produce folded cloth rope.
Figure 10:
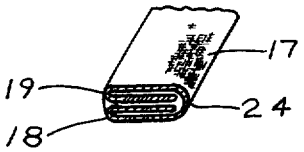
FIG. 10 is a diagram showing the manner in which cloth is folded to form folded cloth rope.

To make folded cloth rope the overlapped layers of the folded and creased cloth on the top 3 of the form 1 are trimmed by cutting both layers simultaneously along the length of the form 1 using the groove 8 as a cutting guide to facilitate making a quick, straight cut without the need for repeated measurements, and thereafter removing the form 1 from within the folded and creased cloth, placing one side 4 or 5 of the form 1 on and along the line formed by the longitudinal trimmed edges of the folded and creased cloth as shown in FIG. 9, folding the exposed half of the folded and creased cloth over the form 1 using the edge 4 or 5 of the form 1 as a folding guide, forming a third longitudinal crease 24 in the cloth by pressing the folded and creased cloth along the third fold with a hot iron, removing the form 1 from within the folded and creased cloth, and stitching together the two longitudinal edges formed in the cloth 18, 19, thus forming a folded cloth rope having four layers of cloth material folded and stitched together as shown in FIG. 10.

I claim:

1. A thin, rigid, solid, rectilinear sewing form comprising a rectangular planar bottom surface; an opposing and parallel rectangular planar top surface; a pair of opposing longitudinal sides adapted to serve as folding guides; a pair of opposing ends; and one or more longitudinal grooves in the top surface parallel to the longitudinal edges of the form and running the full length of the form and located, spaced and adapted to serve as cutting guides for hand making cloth trim tape, cloth pockets or folded cloth rope.

2. A process for hand making cloth trim tape or cloth pockets which comprises the steps of laying cloth material on a table; laying the sewing form of claim 1 on top of the cloth material with the top of the sewing form up; orienting the longitudinal axis of the sewing form in relation to the direction of weave or stretch of the cloth material; adjusting the position of the sewing form in relation to the cloth material so that the cloth material extends beyond both longitudinal sides of the sewing form; folding the cloth extensions over the sewing form using the longitudinal sides of the sewing form as folding guides; creasing the cloth material along the folds by pressing the cloth material with a hot iron; trimming the longitudinal cut edges of the folded and creased cloth material by cutting the cloth along the length of the sewing form using one or more longitudinal cutting guides in the top surface of the sewing form to facilitate making quick, straight cuts; and removing the sewing form from within the cloth trim tape or cloth pocket thus produced.

3. A process for hand making folded cloth rope which comprises the steps of laying cloth material on a table; laying the sewing form of claim 1 on top of the cloth material with the top of the sewing form up; orienting the longitudinal axis of the sewing form in relation to the direction of weave or stretch of the cloth material; adjusting the position of the sewing form in relation to the cloth material so that the cloth material extends beyond both longitudinal sides of the sewing form; folding the cloth extensions over the sewing form using the longitudinal sides of the sewing form as folding guides; creasing the cloth material along the folds by pressing the cloth material with a hot iron; trimming the longitudinal cut edges of the folded and creased cloth material by cutting the cloth along the length of the sewing form using a longitudinal cutting guide in the top surface of the sewing form; removing the sewing form from within the folded and creased cloth material; placing one side of the sewing form on and along the line formed by the longitudinal trimmed edges of the folded and creased cloth; folding the exposed half of the folded and creased cloth over the sewing form using the side of the sewing form as a folding guide; forming a third longitudinal crease in the cloth material by pressing the folded and creased cloth along the third fold with a hot iron; removing the sewing form from within the folded and creased cloth; and stitching together the longitudinal edges formed in the cloth by the first and second creases.

4. A folded cloth rope produced by the process of claim 3.

* * * * *